US012098843B2

(12) United States Patent
Freeman

(10) Patent No.: US 12,098,843 B2
(45) Date of Patent: Sep. 24, 2024

(54) STEAM HAMMER PUMP AND ELECTRICAL POWER FACILITY

(71) Applicant: Constellation Energy Generation, LLC, Kennett Square, PA (US)

(72) Inventor: John M. Freeman, Naperville, IL (US)

( * ) Notice: Subject to any disclaimer, the term of this patent is extended or adjusted under 35 U.S.C. 154(b) by 404 days.

(21) Appl. No.: 17/672,879

(22) Filed: Feb. 16, 2022

(65) Prior Publication Data

US 2023/0258327 A1 Aug. 17, 2023

(51) Int. Cl.

| | |
|---|---|
| ***F22B 37/34*** | (2006.01) |
| ***F22B 29/02*** | (2006.01) |
| ***F22B 35/08*** | (2006.01) |
| ***F22B 37/72*** | (2006.01) |

(52) U.S. Cl.

CPC ..... *F22B 37/34* (2013.01); *F22B 29/02* (2013.01); *F22B 35/08* (2013.01); *F22B 37/72* (2013.01)

(58) Field of Classification Search

CPC ..... F22B 37/34; F22B 29/02; F22B 35/08; F22B 37/72; F01K 3/18

See application file for complete search history.

(56) References Cited

U.S. PATENT DOCUMENTS

| | | | | |
|---|---|---|---|---|
| 14,239 A | | 2/1856 | Holly | |
| RE5,640 E | | 11/1873 | Burdon | |
| 404,730 A | | 6/1889 | Rae | |
| 5,460,161 A | * | 10/1995 | Englehart | F24C 13/00 417/209 |
| 5,938,409 A | | 8/1999 | Radle, Jr. et al. | |
| 8,403,033 B2 | * | 3/2013 | Ahern, Jr. | E03B 3/16 166/105 |
| 11,614,229 B2 | * | 3/2023 | Dock | F22B 1/006 122/406.1 |
| 2010/0083952 A1 | | 4/2010 | van Houten | |
| 2016/0064107 A1 | | 3/2016 | Kim | |

FOREIGN PATENT DOCUMENTS

| | | | |
|---|---|---|---|
| CN | 111780079 A | * | 10/2020 |
| GB | 190930313 A | | 12/1910 |
| JP | 2017067494 A | | 4/2017 |

OTHER PUBLICATIONS

P. Griffith for Massachusetts Institute of Technology; Screening Reactor Steam/Water Piping Systems for Water Hammer; NUREG/CR-6519; Published Sep. 1997; 49 pages.

International Search Report of PCT/US202313085 dated Jun. 6, 2023.

* cited by examiner

*Primary Examiner* — Gregory A Wilson

(74) *Attorney, Agent, or Firm* — Ballard Spahr LLP

(57) ABSTRACT

A pump uses the steam hammer effect to pump water from a reservoir into a control volume. Steam is injected into a water conduit extending between a liquid water reservoir and the control volume forms a liquid steam interface. Steam within the conduit condenses on the interface creating a region of partial vacuum. Water accelerates into the region of partial vacuum and is vented into the control volume, flow being controlled by a valve.

34 Claims, 5 Drawing Sheets

STEAM HAMMER PUMP AND ELECTRICAL POWER FACILITY

FIELD OF THE INVENTION

This invention relates to pumps for pumping fluids.

BACKGROUND

There is a need to increase the production of electrical power without increasing the adverse effects of power generation on the environment. One approach to this challenge is to increase the operating efficiency of existing and future power plants. It is estimated that power plants burning fossil fuels operate at an efficiency of about 33%, leaving much room for improvement. Even nuclear power plants, which operate at an estimated 34% efficiency, could benefit from an increase in plant operating efficiency.

SUMMARY

In one embodiment the invention concerns a pump for injecting liquid water into a control volume. In an example embodiment the pump comprises a liquid water reservoir. A water conduit provides fluid communication between the liquid water reservoir and the control volume. An exhaust valve is positioned within the water conduit for controlling flow of the liquid water from the liquid water reservoir into the control volume. The example pump further comprises a steam reservoir and a steam conduit providing fluid communication between the steam reservoir and the water conduit. A steam injector valve is positioned in the steam conduit for controlling flow of the steam from the steam reservoir into the water conduit. Opening the steam injector valve injects steam into the water conduit, the steam condenses on a water-steam interface thereby creating a partial vacuum within the water conduit. The liquid water from the liquid water reservoir accelerates into the partial vacuum creating a pressure and momentum pulse within the water conduit. The exhaust valve opens to permit a burst of the liquid water to be injected into the control volume.

In an example embodiment the control volume contains a high internal pressure, and the exhaust valve opens when the pressure and momentum pulse exceeds the high internal pressure within the control volume thereby permitting a burst of the liquid water to be injected therein. In a specific example the exhaust valve comprises a check valve which could be a remotely controlled valve. By way of further example the exhaust valve may be positioned proximate to an interface between the water conduit and the control volume. In another example the steam injector valve may be positioned proximate to the exhaust valve. An example embodiment may comprise a plurality of the steam injector valves positioned proximate to the exhaust valve. In a specific example embodiment the plurality of the steam injector valves are positioned in spaced relation around a perimeter of the water conduit. Another example embodiment may comprise a plurality of the steam injector valves positioned in spaced relation lengthwise along the water conduit. By way of example, at least one steam injector valve of the plurality is positioned proximate to the exhaust valve.

An example pump according to the invention may further comprise a cooling water reservoir and a cooling water conduit providing fluid communication between the cooling water reservoir and the water conduit. A cooling water injector valve is positioned within the cooling water conduit for controlling flow of cooling water from the cooling water reservoir into the water conduit. Opening the cooling water injector valve permits the cooling water to enter the water conduit, thereby increasing a rate of condensation of the steam within the water conduit.

In a specific example embodiment the cooling water injector valve is positioned proximate to an interface between the cooling water conduit and the water conduit. By way of further example the cooling water injector valve may be positioned proximate to the steam injector valve. An example embodiment may comprise a plurality of the cooling water injector valves positioned proximate to the steam injector valve. By way of further example the plurality of the cooling water injector valves may be positioned in spaced relation around a perimeter of the water conduit. In another example a plurality of the cooling water injector valves may be positioned in spaced relation lengthwise along the water conduit. In a specific example at least one of the cooling water injector valves of the plurality is positioned proximate to the steam injector valve.

An example embodiment may further comprise a coolant pump positioned between the cooling water reservoir and the cooling water conduit for pumping the cooling water from the cooling water reservoir into the water conduit. By way of example the cooling water reservoir may comprise the liquid water reservoir. An example embodiment of a pump according to the invention may further comprise the control volume. In an example embodiment the control volume may comprise a steam boiler. In another example the control volume may comprise a plenum in fluid communication with the steam boiler. By way of further example the steam boiler may comprise the steam reservoir.

A further example embodiment may comprise a flow conditioning element positioned within the water conduit. In a specific example the flow conditioning element may comprise a vortex generator comprising at least one vane.

An example pump according to the invention may further comprise a control system. The control system may selected from the group including a programmable controller, an analog controller, a mechanical controller or a simple periodic wave form controller. By way of example the pump may further comprise a programmable controller and at least one sensor positioned within the water conduit. The at least one sensor is adapted to measure a physical parameter within the water conduit and transmit a signal indicative of the physical parameter to the programmable controller. By way of example the programmable controller is in communication with the steam injector valve for controlling opening and closing thereof, and the programmable controller may also be in communication with the exhaust valve for controlling opening and closing thereof. In an example embodiment the physical parameter may comprise pressure, temperature, flow rate, or void fraction, or a combination thereof within the water conduit.

The invention also encompasses a method of injecting liquid water into a control volume. In an example embodiment the method comprises:

- injecting steam into a conduit in fluid communication with the control volume, the conduit containing the liquid;
- condensing the steam at a steam-water interface within the conduit thereby creating a partial vacuum region within the conduit;
- accelerating the liquid water into the partial vacuum region thereby creating a pressure and momentum pulse within the conduit; and venting the liquid water into the control volume, the liquid water being propelled by the pressure and momentum pulse.

By way of example, the method according to the invention may further comprise forming turbulent flow of the liquid water at the steam-water interface as well as cooling the steam proximate to the steam-water interface. In an example embodiment the cooling may comprise injecting cooling water into the partial vacuum region.

DETAILED DESCRIPTION

Figure 1:
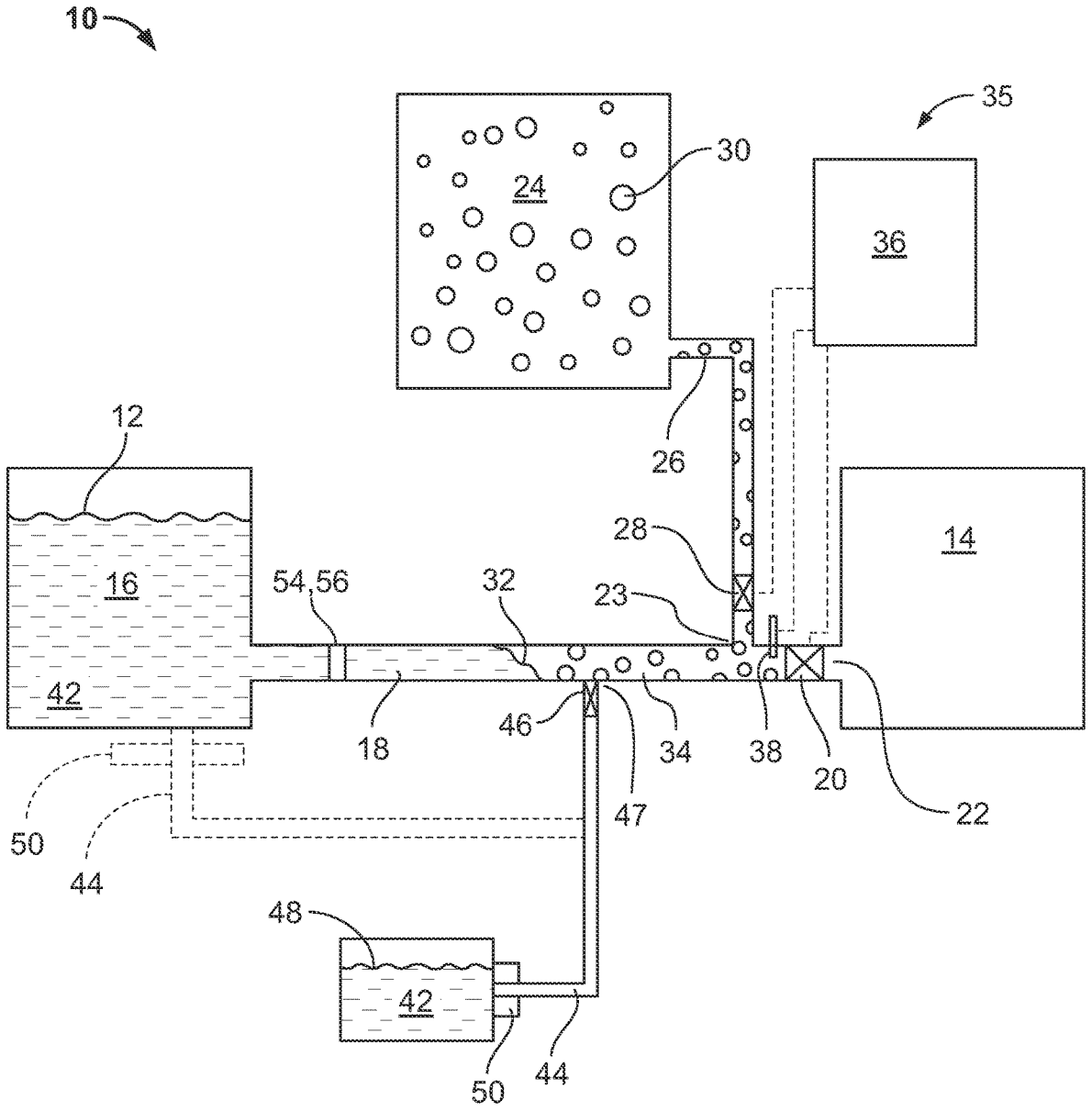
FIG. 1 is a schematic diagram of an example pump according to the invention.

As shown in FIG. 1, one aspect of the invention concerns a pump 10 for injecting liquid water 12 into a control volume 14. In an example embodiment, the pump 10 comprises a liquid water reservoir 16. A water conduit 18 provides fluid communication between the liquid water reservoir 16 and the control volume 14. An exhaust valve 20 is positioned within the water conduit 18 for controlling flow of the liquid water 12 from the liquid water reservoir 16 into the control volume 14. As shown in FIG. 1, it is advantageous to position the exhaust valve 20 proximate to an interface 22 between the water conduit 18 and the control volume 14.

Pump 10 further includes a steam reservoir 24 and a steam conduit 26 which provides fluid communication between the steam reservoir 24 and the water conduit 18. A steam injector valve 28 is positioned in the steam conduit 26 for controlling flow of steam 30 from the steam reservoir 24 into the water conduit 18. Steam conduit 26 is connected to water conduit 18 at a point 23 between water reservoir 16 and the exhaust valve 20. It is considered advantageous to position the connection point 23 and the steam injector valve 28 proximate to the exhaust valve 20. However, placement can be optimized as common practice.

Operation of pump 10 proceeds by opening the steam injector valve 28, thereby injecting steam 30 into the water conduit 18 which pushes water in conduit 18 in the backward direction towards reservoir 16. The steam 30 condenses on a water-steam interface 32 created upon steam injection. The condensing steam creates a region of partial vacuum 34 within the water conduit 18. The liquid water 12 from the liquid water reservoir 16 then moves in the forward direction toward the control volume 14, and accelerates into the partial vacuum creating a pressure and momentum pulse within the water conduit 18. The pressure and momentum pulse, commonly known as the "steam hammer effect", is described by the Joukowsky equation, which equates the change in pressure to the product of the density of the fluid, the speed of sound in the fluid, and the change in fluid velocity. In its simplest form, the energy of this "steam hammer" may be harnessed by judiciously opening steam injector valve 28, thereby creating a steam bubble that condenses and collapses in a favorable way to cause a localized pressure build up greater than the pressure in control volume 14. The exhaust valve 20 permits a burst of the accelerating liquid water 12 to be injected into the control volume 14 because of the higher local pressure than in the control volume 14, and because of the kinetic energy of the water mass and associated velocity inside conduit 18 in the direction of the exhaust valve 20.

In an example application of pump 10, if the control volume 14 contains a high internal pressure (as in a steam boiler), the exhaust valve 20 may advantageously comprise a check valve which opens when the pressure and momentum pulse within water conduit 18 near check valve 20 exceeds the high internal pressure within the control volume 14 (steam boiler) thereby permitting a burst of the liquid water to be injected therein. As the kinetic energy is converted to pressure and flow, the pressure will decrease resulting in back flow water hammer within the water conduit 18 which would otherwise occur when the exhaust valve 20 closes abruptly once the pressure in the control volume 14 and the water conduit 18 equalizes. The back flow water hammer effect is mitigated, for example, by the use of "nozzle check" valves, commercially available from Crane ChemPharma & Energy of The Woodlands, Texas, under the brand "NOZ-CHEK®" as well as other vendors with similar designs.

In an example application wherein the control volume 14 is at a relatively low pressure, for example, atmospheric, the exhaust valve 20 may comprises a remotely controlled valve. In this application, pump 10 may further comprise a control system 35, for example, a programmable controller 36, such as an Allen Bradley Programmable Logic Controller marketed by Rockwell Automation of Milwaukee, Wisconsin, and optionally one or more sensors 38 positioned within the water conduit. Analog controllers, mechanical controllers or simple periodic wave form controllers could also comprise a practical control system. Sensors 38 may be adapted to measure various physical parameters, such as temperature, flow rate and void fraction (the fraction of the channel volume or channel cross sectional area that is occupied by the gas phase) within the water conduit 18 and transmit a signal indicative of the physical parameters to the programmable controller 36. In this example the physical parameter is advantageously pressure. The programmable controller 36 is in communication with both the steam injector valve 28 and the exhaust valve 20 for controlling and thus coordinating the opening and closing of both valves to effect pumping of water from the liquid water reservoir 16 to the control volume 14, which, for example, could comprise the ambient, or higher pressure if required. It is also understood that analog controllers, mechanical controllers or simple periodic wave form controllers could also be used to control both the steam injector valve 28 and the exhaust valve 20 through mechanical or electromechanical devices, linkages and mechanisms.

Figure 2:
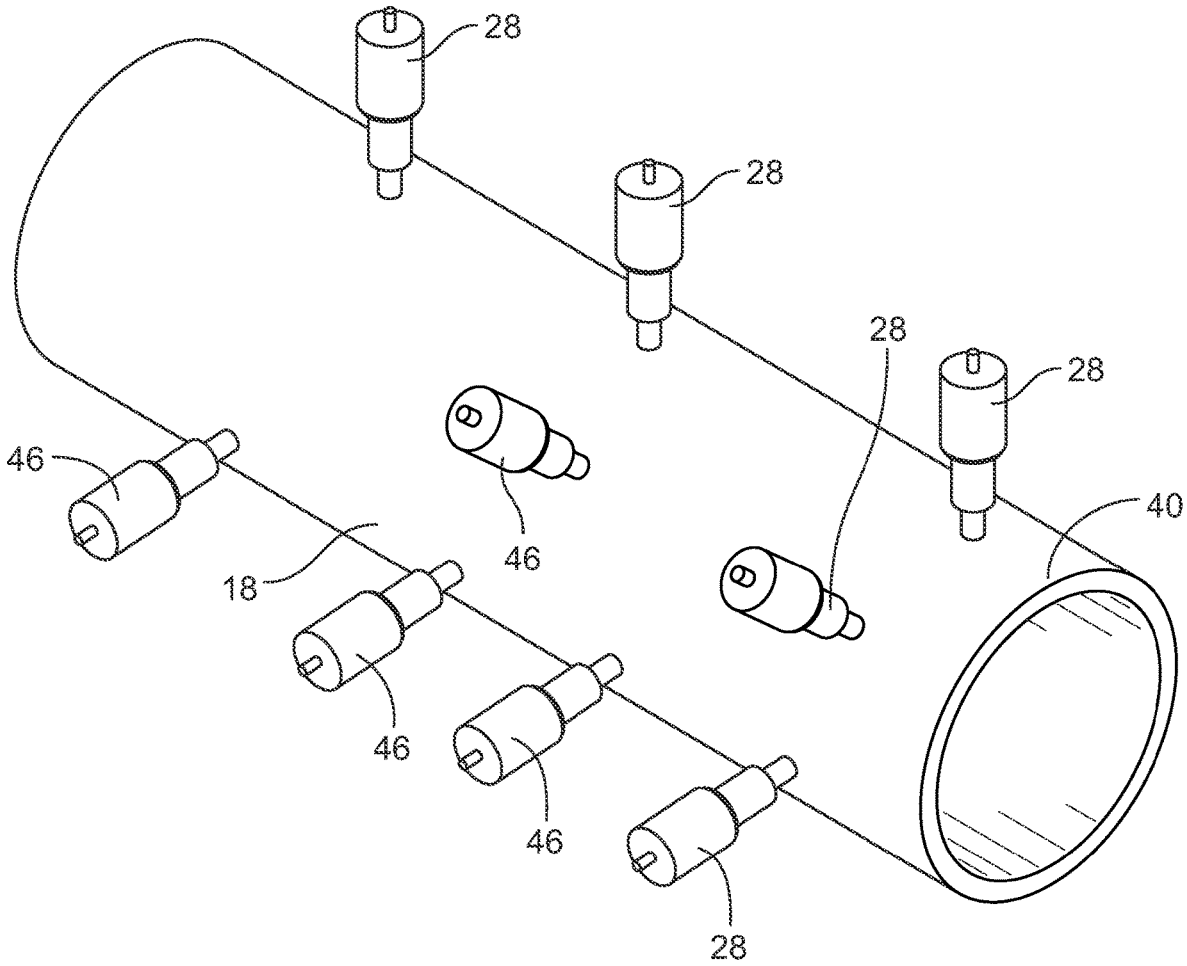
FIG. 2 shows an example component of the example pump of FIG. 1.

Performance of pump 10 may be adjusted by the positioning and number of steam injector valves 28 on the water conduit 18. As noted, it is advantageous to position at least one steam injector valve 28 proximate to the exhaust valve 20. This position of the steam injector valve 28 allows the region of partial vacuum 34 to be created between most of the liquid water 12 within the water conduit 18 and the exhaust valve 20 for maximum injection of liquid water into the control volume 14. By way of further example, pump 10 may comprise a plurality of the steam injector valves 28 positioned proximate to the exhaust valve 20. In this example, as shown in FIG. 2, steam injector valves 28 may be positioned in spaced relation around a perimeter 40 of the water conduit 18. In another example embodiment, also shown in FIG. 2, a plurality of the steam injector valves 28 may be positioned in spaced relation lengthwise along the water conduit 18. The position and number of steam injector valves 28 on the water conduit 18 may be used to control the position of the water-steam interface 32 and the size of the region of partial vacuum 34. The timing and amount of steam injected by each steam injector valve 28 may be controlled by the programmable controller 36 or other control system and in response to sensor data provided by one or more sensors 38 (if present) to achieve a desired pump output volume and pressure. Performance of pump 10 may be adjusted by various injection 18 nozzles and shapes, as well as various conduit 18 cross-sectional shapes in addition to simple circular shapes, and variable areas along the length.

As further shown in FIG. 1, performance of pump 10 may be further tuned using a cooling water reservoir 42 and a cooling water conduit 44 providing fluid communication between the cooling water reservoir 42 and the water conduit 18. In this example, a cooling water injector valve 46, advantageously having, for example, a spray nozzle designed to deliver small cool water droplets into the steam space, is employed. Valve 46 is positioned within the cooling water conduit 44 for controlling flow of cooling water 48 from the cooling water reservoir 42 and injected (e.g., sprayed) into the water conduit 18. Injection of cooling water 48 into the water conduit 18, either at the water-steam interface 32 or otherwise in the region of partial vacuum 34 increases the rate of condensation of the steam 30 within the water conduit 18 thereby increasing the magnitude of the pressure and momentum pulse. A coolant pump 50, located between the cooling water reservoir 42 and the cooling water conduit 44, may be used to pump the cooling water from the cooling water reservoir into the water conduit 18. Cooling water 48 injected at the water-steam interface 32 has the added benefit of disrupting the water surface of the water-steam interface and thereby inhibiting temperature stratification of the water, resulting in more rapid heat transfer between the steam 30 and liquid water 12, thereby increasing the rate of condensation and increasing the magnitude of the pressure and momentum pulse. To this end it is considered advantageous to position the injector valve 46 proximate to an interface 47 between the cooling water conduit 44 and the water conduit 18 as well as proximate to the steam injector valve 28. However, placements can be optimized as common practice.

Further performance enhancements may be achieved using a plurality of the cooling water injector valves 46 positioned proximate to the steam injector valve 28, as shown by way of example in FIG. 2. The plurality of the cooling water injector valves 46 may be positioned in spaced relation around a perimeter 40 of the water conduit 18 similar to the steam injectors valves 28. Additionally, as shown in FIG. 2, a plurality of the cooling water injector valves 46 (which may advantageously comprise droplet spray nozzles) may be positioned in spaced relation lengthwise along the water conduit 18. FIG. 1 shows two example embodiments wherein, in one embodiment, the cooling water reservoir 42 comprises the liquid water reservoir 16, the cooling water conduit 44 shown in broken line. In the other example embodiment, the cooling water reservoir 42 comprises a separate reservoir.

Figure 5:
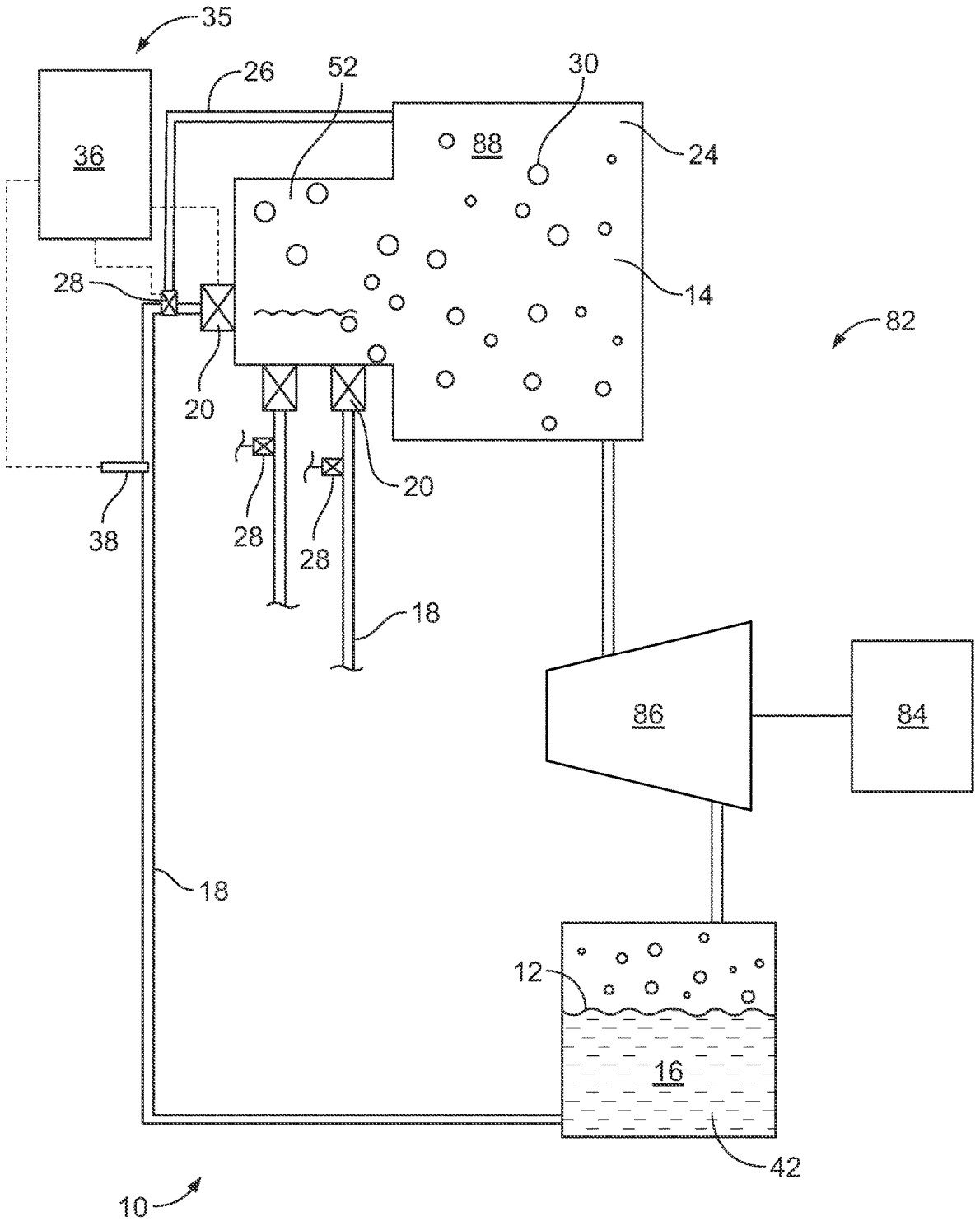
FIG. 5 is a schematic diagram of an example power generating facility using an example pump according to the invention.

In an example embodiment shown in FIG. 5, both the control volume 14 and the steam reservoir 24 comprise a steam boiler 88. The control volume 14 may also comprise a plenum 52 in fluid communication with the steam boiler. Plenum 52 may receive multiple water conduit inputs from exhaust valves 20 of other pumps in an example embodiment.

Performance of pump 10 may also be enhanced using flow conditioning elements within the water conduit 18. As shown in FIG. 1, a flow conditioning element 54 may be positioned within the water conduit 18. In a specific example embodiment, the flow conditioning element 54 may comprises a vortex generator or other flow conditioning element and may comprise at least one vane 56. The flow conditioning element 54 is expected to create turbulent flow at the water-steam interface 32 to inhibit temperature stratification of the liquid water at the water-steam interface. The turbulent flow is expected to promote mixing and increase heat transfer from the steam to the water, thereby increasing the rate of condensation. This effect should provide for a more rapid formation of the region of partial vacuum 34, which should increase the rate of acceleration of the water and thereby boost the pressure and momentum pulse. While the conduits shown in FIGS. 1, 2 and 5 may have circular cross sections they could have any practical geometric, or irregular shape as well as variable cross sectional areas along their length for structural reasons or for performance optimization.

Figure 3:
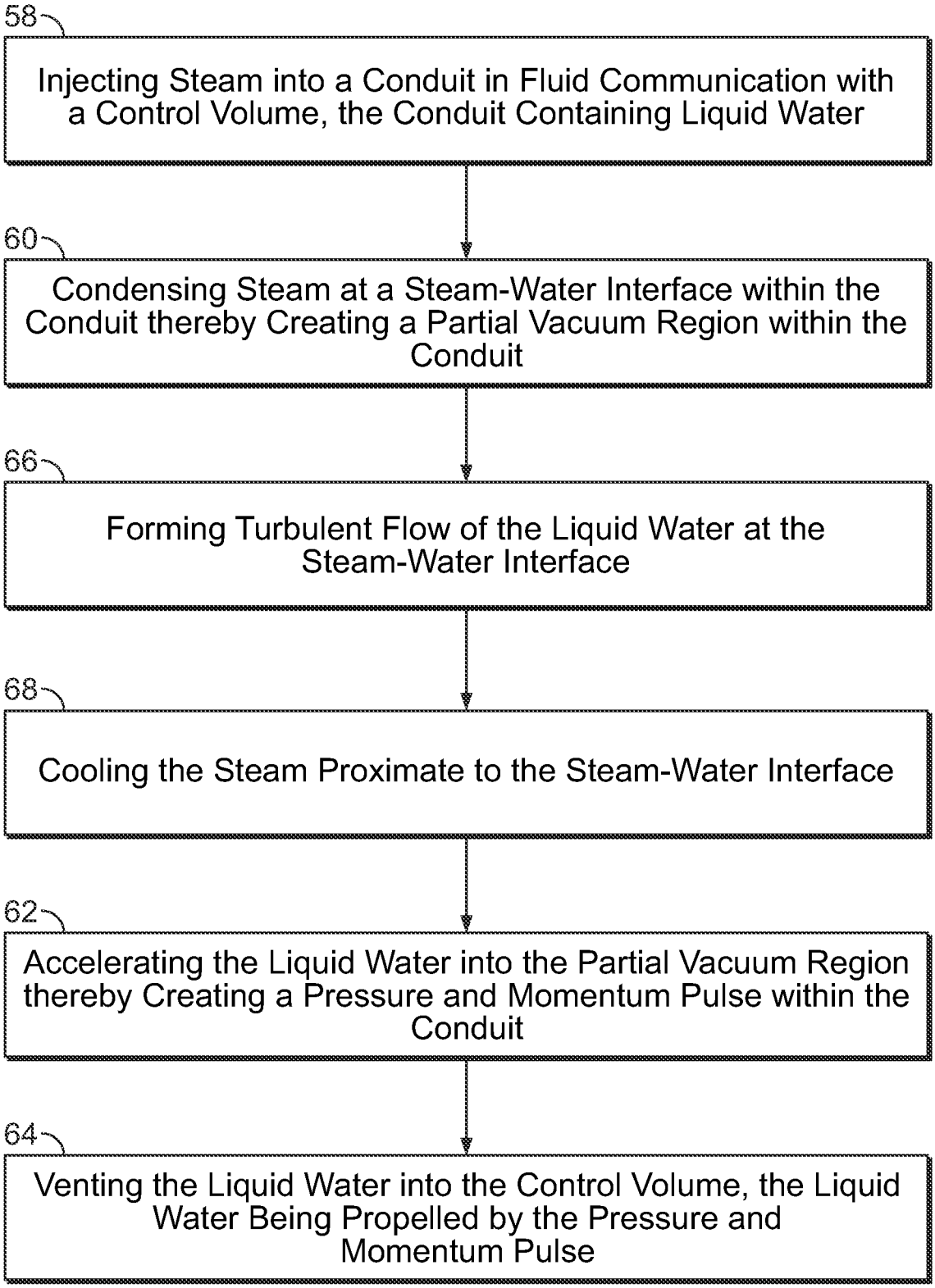
FIGS. 3 and 4 are flow charts showing example methods according to the invention.

The invention further encompasses a method of injecting liquid water into a control volume. As shown with reference to FIG. 3, an example method comprises:

- injecting steam into a conduit in fluid communication with the suction control volume, the conduit containing the liquid water (58);
- condensing the steam at a steam-water interface within the conduit thereby creating a partial vacuum region within the conduit (60);
- accelerating the liquid water into the partial vacuum region thereby creating a pressure and momentum pulse within the conduit (62); and
- venting the liquid water into the control volume, the liquid water being propelled by the pressure and momentum pulse (64).

Additional steps may include: forming turbulent flow of the liquid water at the steam-water interface (66); cooling the steam proximate to the steam-water interface (68) by, for example, injecting cooling water into the partial vacuum region.

Figure 4:
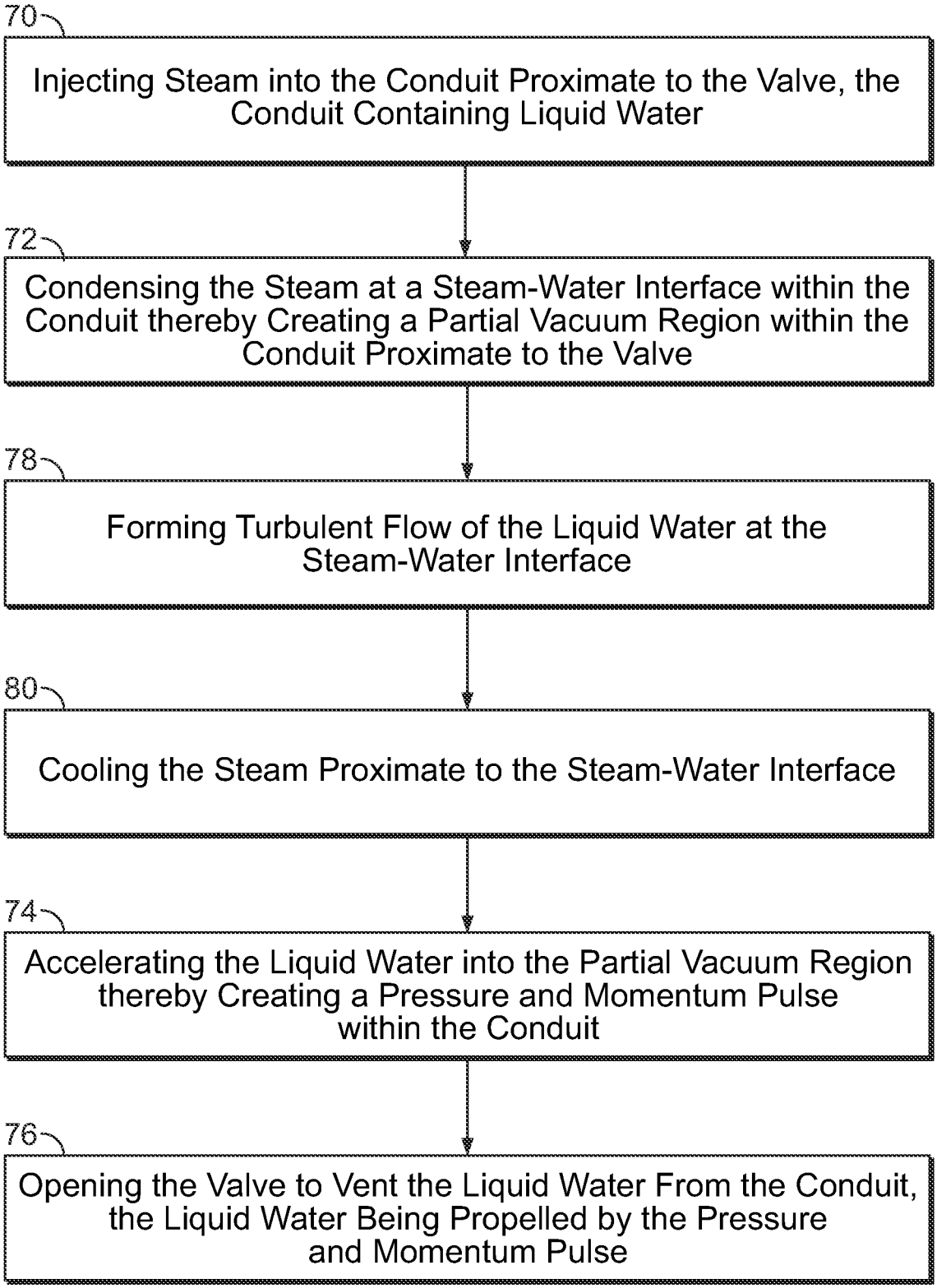

A further embodiment of the invention comprises a method of projecting liquid water from a conduit having one end in fluid communication with a liquid water reservoir, and an opposite end closed by a valve. As shown in FIG. 4, an example method comprises:

- injecting steam into the conduit proximate to the valve, the conduit containing the liquid water (70);
- condensing the steam at a steam-water interface within the conduit thereby creating a partial vacuum region within the conduit proximate to the valve (72);
- accelerating the liquid water into the partial vacuum region thereby creating a pressure and momentum pulse within the conduit (74); and
- opening the valve to vent the liquid water from the conduit, the liquid water being propelled by the pressure and momentum pulse (76).

Additional steps may include: forming turbulent flow of the liquid water at the steam-water interface (78); cooling the steam proximate to the steam-water interface (80) by, for example, injecting cooling water into the partial vacuum region.

FIG. 5 shows a practical application of pump 10 used in a facility 82 for generating electrical power. In an example embodiment, the facility 82, which could be a fossil burning plant or a nuclear plant, comprises an electrical generator 84. A steam turbine 86 is coupled to the electrical generator 84. Turbine 86 is intended to extract the maximum kinetic energy from the steam and apply that energy to the generator. A steam boiler 88 serves as the steam reservoir 24 for the pump 10 and is adapted to provide steam to the steam turbine 86 for operating the electrical generator 84. Pump 10 includes the liquid water reservoir 16 which receives condensate and steam exhaust from the turbine 86 where the steam is further condensed and the condensate cooled. The water conduit 18 provides fluid communication between the liquid water reservoir 16 and the steam boiler 88, which, in this example also comprises the control volume 14. The exhaust valve 20 is positioned within the water conduit 18 for controlling flow of the liquid water 12 from the liquid water reservoir 16 into the steam boiler 88 (control volume 14). Steam conduit 26 provides fluid communication from the steam boiler 88 to the water conduit 18. At least one steam injector valve 28 is positioned in the steam conduit 26 for controlling flow of the steam 30 from the steam boiler 88 into the water conduit 18.

When it is desired to inject liquid water 12 into boiler 88, the steam injector valve 28 is opened and injects steam 30 into the water conduit 18. It is advantageous if the temperature of the steam is 20° C. (36° F.) higher than the temperature of the water in the water conduit 18. Further advantage may be secured of the length to diameter ratio of water conduit 18 is greater than 24, as this is expected to promote a vigorous condensing water hammer. The steam 30 condenses on the water-steam interface created by the injected steam, thereby creating the region of partial vacuum within the water conduit 18. The liquid water from the water reservoir 16 accelerates into the partial vacuum creating a pressure and momentum pulse within the water conduit 18. The exhaust valve 20 opens, permitting a burst of the liquid water 12 to be injected into the steam boiler 88 by the water conduit 18. In an example embodiment, exhaust valve 20 may comprise a check valve which opens automatically when the magnitude of the local pressure and momentum pulse exceeds the pressure within the steam boiler 88. Back flow water hammer within the water conduit 18, which would otherwise occur when the exhaust valve 20 closes abruptly, is mitigated by the use of a "nozzle check" valve as described above.

In another example embodiment, the exhaust valve 20 may comprise a remotely controlled valve. In this example facility 82 further comprises the control system 35, for example, the programmable controller 36 and one or more sensors 38 positioned within the water conduit 18. In this example the sensor 38 is adapted to measure pressure within the water conduit 18 and transmit an electrical signal indicative of the pressure to the programmable controller 36. The programmable controller 36 is in communication with both the steam injector valve 28 and the exhaust valve 20 for controlling the timing and duration of the opening and closing of both the exhaust valve 20 and the steam injector valve 28. It is also understood that the control system 35 could comprise analog controllers, mechanical controllers or simple periodic wave form controllers to control both the steam injector valve 28 and the exhaust valve 20 through mechanical or electromechanical devices, linkages and mechanisms.

Detailed design concerning the number and placement of the steam injector valves 28 in the water conduit 18 of pump 10 used in the facility 82 is as described above for the pump 10. Design and operation of the cooling water system comprising the cooling water reservoir 42, cooling water conduit 44 and cooling water spray injector valves 46 is also as described above. In the example embodiment of FIG. 5, the cooling water reservoir 42 is also the liquid water reservoir 16. It is further advantageous if the plenum 52 is part of the steam boiler 88. Plenum 52 allows injection of liquid water from multiple water conduits 18 from other liquid water reservoirs (not shown) receiving low pressure steam and condensate from other turbines (not shown). As further described above, a flow conditioning element such as a vortex generator or other flow conditioner may be positioned within the water conduit 18 to enhance performance of pump 10.

It is expected that example pumps 10 according to the invention will have many beneficial uses. Because pump 10 can use the boiler pressure steam to feed water to the boiler at an even greater pressure, it does not need multiple stages to pump from condensate and is expected to obviate the use of condensate booster and feedwater pumps. Furthermore, it does not use "House" electrical energy to pump the water. Thus, it increases the electrical output of the power station. Additionally, steam energy is not wasted in the condenser because much of the driving steam energy is returned to the boiler. It is expected that much of the warmer water stream extracted from the turbine could be pumped using pumps according to the invention if the steam in the water stream is separated from the water stream and steam jet ejectors are used to lower tank pressure. In this way, boiler energy is not wasted through condensation because the condenser is bypassed. This is expected to lower the heat load on the condenser, lower the condenser's overall cooling temperature and increase generator efficiency. If the steam pump and steam ejector is optimized, it could completely bypass the condenser. Use of pump 10 is expected to increase thermal efficiency from the current 34% to over 90% in nuclear power plants for example. This has great potential advantage because much less fuel would be required at higher thermal efficiencies. Lower fuel cost also reduces the nuclear waste stream. Use of example pumps 10 according to the invention may radically disrupt the tradition "Rankine" cycle used for electrical generation plants. The Rankine cycle requires all turbine output to be condensed (and thus wastes energy) because centrifugal water pumps must pump water, not a mix of water and steam. It is expected that the same approach might be used to reduce fossil fueled burn rate and thus reduce production of $CO_2$ of current legacy power plant thermal generation. It is estimated that power plants 82 shown by way of example using pumps 10 with optimal configuration according to the invention may have global impact by reducing electrical production costs and $CO_2$ emissions up to 65%.

What is claimed is:

1. A pump for injecting liquid water into a control volume, said pump comprising:

a liquid water reservoir;

a water conduit providing fluid communication between said liquid water reservoir and said control volume;

an exhaust valve positioned within said water conduit for controlling flow of said liquid water from said liquid water reservoir into said control volume;

a steam reservoir;

a steam conduit providing fluid communication between said steam reservoir and said water conduit;

a steam injector valve positioned in said steam conduit for controlling flow of said steam from said steam reservoir into said water conduit; wherein opening said steam injector valve injects steam into said water conduit, said steam condensing on a water-steam interface thereby creating a partial vacuum within said water conduit, said liquid water from said liquid water reservoir accelerating into said partial vacuum creating a pressure and momentum pulse within said water conduit, said exhaust valve opening permitting a burst of said liquid water to be injected into said control volume.

2. The pump according to claim 1, wherein said control volume contains a high internal pressure, said exhaust valve opening when said pressure and momentum pulse exceeds said high internal pressure within said control volume thereby permitting a burst of said liquid water to be injected therein.

3. The pump according to claim 2, wherein said exhaust valve comprises a check valve.

4. The pump according to claim 1, wherein said exhaust valve comprises a remotely controlled valve.

5. The pump according to claim 1, wherein said exhaust valve is positioned proximate to an interface between said water conduit and said control volume.

6. The pump according to claim 5, wherein said steam injector valve is positioned proximate to said exhaust valve.

7. The pump according to claim 6, further comprising a plurality of said steam injector valves positioned proximate to said exhaust valve.

8. The pump according to claim 7, wherein said plurality of said steam injector valves are positioned in spaced relation around a perimeter of said water conduit.

9. The pump according to claim 5, further comprising a plurality of said steam injector valves positioned in spaced relation lengthwise along said water conduit.

10. The pump according to claim 9, wherein at least one said steam injector valves of said plurality is positioned proximate to said exhaust valve.

11. The pump according to claim 1, further comprising:

a cooling water reservoir;

a cooling water conduit providing fluid communication between said cooling water reservoir and said water conduit;

a cooling water injector valve positioned within said cooling water conduit for controlling flow of cooling water from said cooling water reservoir into said water conduit; wherein opening said cooling water injector valve permits said cooling water to enter said water conduit, thereby increasing a rate of condensation of said steam within said water conduit.

12. The pump according to claim 11, wherein said cooling water injector valve is positioned proximate to an interface between said cooling water conduit and said water conduit.

13. The pump according to claim 12, wherein said cooling water injector valve is positioned proximate to said steam injector valve.

14. The pump according to claim 13, further comprising a plurality of said cooling water injector valves positioned proximate to said steam injector valve.

15. The pump according to claim 14, wherein said plurality of said cooling water injector valves are positioned in spaced relation around a perimeter of said water conduit.

16. The pump according to claim 12, further comprising a plurality of said cooling water injector valves positioned in spaced relation lengthwise along said water conduit.

17. The pump according to claim 16, wherein at least one said cooling water injector valve of said plurality is positioned proximate to said steam injector valve.

18. The pump according to claim 11, further comprising a coolant pump positioned between said cooling water reservoir and said cooling water conduit for pumping said cooling water from said cooling water reservoir into said water conduit.

19. The pump according to claim 11, wherein said cooling water reservoir comprises said liquid water reservoir.

20. The pump according to claim 1, further comprising said control volume.

21. The pump according to claim 20, wherein said control volume comprises a steam boiler.

22. The pump according to claim 21, wherein said control volume comprises a plenum in fluid communication with said steam boiler.

23. The pump according to claim 21, wherein said steam boiler comprises said steam reservoir.

24. The pump according to claim 1, further comprising a flow conditioning element positioned within said water conduit.

25. The pump according to claim 24, wherein said flow conditioning element comprises a vortex generator comprising at least one vane.

26. The pump according to claim 1, further comprising a control system, said control system being selected from the group including a programmable controller, an analog controller, a mechanical controller or a simple periodic wave form controller.

27. The pump according to claim 26, wherein said physical parameter comprises pressure, temperature, flow rate, or void fraction, or a combination thereof within said water conduit.

28. The pump according to claim 1, further comprising:

a programmable controller;

at least one sensor positioned within said water conduit, said at least one sensor adapted to measure a physical parameter within said water conduit and transmit a signal indicative of said physical parameter to said programmable controller.

29. The pump according to claim 28, wherein said programmable controller is in communication with said steam injector valve for controlling opening and closing thereof.

30. The pump according to claim 29, wherein said programmable controller is in communication with said exhaust valve for controlling opening and closing thereof.

31. A method of injecting liquid water into a control volume, said method comprising:

injecting steam into a conduit in fluid communication with said control volume, said conduit containing said liquid;

condensing said steam at a steam-water interface within said conduit thereby creating a partial vacuum region within said conduit;

accelerating said liquid water into said partial vacuum region thereby creating a pressure and momentum pulse within said conduit; and venting said liquid water into said control volume, said liquid water being propelled by said pressure and momentum pulse.

32. The method according to claim 31, further comprising forming turbulent flow of said liquid water at said steam-water interface.

33. The method according to claim 31, further comprising cooling said steam proximate to said steam-water interface.

34. The method according to claim 33, wherein said cooling comprises injecting cooling water into said partial vacuum region.

* * * * *